United States Patent [19]

Stahlecker

[11] Patent Number: 4,858,423

[45] Date of Patent: Aug. 22, 1989

[54] FIBER FEEDING ARRANGEMENT FOR OPEN-END ROTOR SPINNING

[75] Inventor: Fritz Stahlecker, Bad Überkingen, Fed. Rep. of Germany

[73] Assignee: Hans Stahlecker, Fed. Rep. of Germany

[21] Appl. No.: 237,332

[22] Filed: Aug. 29, 1988

[30] Foreign Application Priority Data

Sep. 12, 1987 [DE] Fed. Rep. of Germany ..... 3730706

[51] Int. Cl.[4] ..... D01H 7/898; D01H 7/892

[52] U.S. Cl. ..... 57/413; 57/408; 57/411

[58] Field of Search ..... 57/404, 406, 407, 411, 57/413

[56] References Cited

U.S. PATENT DOCUMENTS 3,411,283 11/1968 Isomura ..... 57/413 X
3,834,148 9/1974 Sakurai et al. ..... 57/413
3,948,031 4/1976 Jozwicki et al. ..... 57/413 X
3,956,876 5/1976 Artzt et al. ..... 57/413
4,459,800 7/1984 Stahlecker ..... 57/411
4,672,804 6/1987 Anahara et al. ..... 57/413 X
4,738,097 4/1988 Brockmanns et al. ..... 57/411 X

FOREIGN PATENT DOCUMENTS 3120877 12/1982 Fed. Rep. of Germany .
3247411 6/1984 Fed. Rep. of Germany .

*Primary Examiner*—John Petrakes
*Attorney, Agent, or Firm*—Barnes & Thornburg

[57] ABSTRACT

In an arrangement for open-end rotor spinning, it is provided that a fiber feeding duct, starting from its end located opposite a fiber sliding surface of a spinning rotor, is opened up by means of a lateral slot so that the cross-section that is essential for the taken-in air quantity is placed back in an area with a larger diameter, while, in addition, the end area of the fiber feeding duct is designed as a narrow groove.

19 Claims, 3 Drawing Sheets

FIG.4
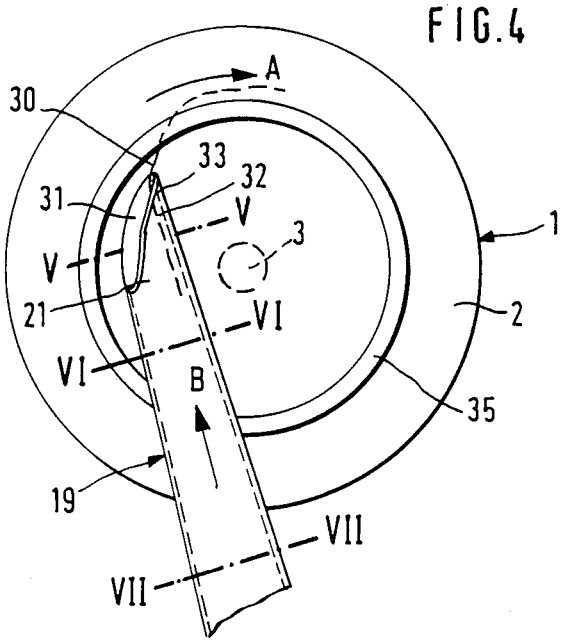
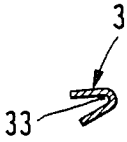
FIG.5
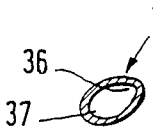
FIG.6
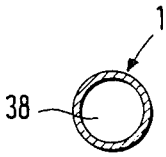
FIG.7

FIBER FEEDING ARRANGEMENT FOR OPEN-END ROTOR SPINNING

BACKGROUND AND SUMMARY OF THE INVENTION

The invention relates to an arrangement for open-end rotor spinning having a spinning rotor which has a fiber sliding surface expanding conically into a fiber collecting groove, a fiber feeding duct being directed to this fiber sliding surface which starts at an opening roller and tapers in the direction toward the fiber sliding surface. An insert projects into the spinning rotor and contains the end area of the fiber feeding duct and a yarn withdrawal nozzle, this insert being part of a cover which closes off a rotor housing which is connected to a vacuum source which takes in an air current via the fiber feeding duct.

In the case of arrangements of this type, as they are known, for example, from DE-A-32 47 411, the fiber feeding duct must have a sufficiently large cross-section up to its mouth so that, in the case of a given pressure gradient, a sufficiently large amount of air can be sucked through which permits optimum conveying of the fibers. The fibers conveyed in the fiber feeding duct must impact on the fiber sliding wall of the spinning rotor at a sufficient distance from the open end as well as from the fiber collecting groove. On the one hand, it must be avoided that the fibers are moved away over the open rotor edge with the conveying air, while, on the other hand, a sufficient path is required on the sliding surface so that the fibers can still be properly guided and stretched to the fiber collecting groove. In the case of modern rotor spinning machines, there is the tendency for the rotors to become progressively smaller so that the above-mentioned requirements lead to difficulties. On the one hand, it is necessary to supply the fibers in a very targeted way to a certain point of the fiber sliding surface of the spinning rotor, which can be realized by means of a fiber feeding duct with a small mouth. However, this small mouth results in an unacceptable reduction of the taken-in quantity of air required for the conveying. In order to solve this problem, it was proposed in an earlier commonly assigned U.S. application Ser. No. 149,175, filed Jan. 27, 1988, now abandoned, and based on German Application P 37 04 460.5, that the mouth of the fiber feeding duct be constructed to be large in circumferential direction of the spinning rotor, but that it be kept as small as possible in the direction of the height of the fiber sliding wall It is also known (DE-A-31 20 877) to prevent as much as possible the depositing of fine dirt particles, particularly dust, in the spinning rotor. In the known construction, it is therefore provided that the fibers, as early as before they enter the spinning rotor, are separated from the conveying air current and thus also from fine particles For this purpose, in the known construction, the fiber feeding duct is opened up, before the spinning rotor is reached. In one embodiment, the fiber feeding duct is then equipped with a groove-shaped extension which extends to the sliding surface of the spinning rotor. A concentration of the impacting point of the fibers on the fiber sliding wall is not endeavored in the known construction.

An object of the invention is to develop an arrangement of the initially mentioned type such that, on the one hand, a sufficiently large amount of air can be taken in by the fiber duct, while, on the other hand, a sufficiently high precision is ensured with respect to the impacting point of the fibers on the fiber sliding surface of the spinning rotor.

This object is achieved according to preferred embodiments of the invention in that the fiber feeding duct, starting from its end that is opposite the fiber sliding surface, is opened up by means of a lateral slot so that the cross-section of the fiber feeding duct that is consequential to the taken-in amount of air is placed back in an area with a larger cross-section, and in that the end area of the fiber feeding duct is shaped as a groove, the groove base of which has a radius of no more than 2.5 mm.

By means of this construction, on the one hand, a sufficiently large amount of air is taken in, while, on the other hand, the alignment of the fiber conveyance is improved Among other things, the fibers are also pressed into the groove base by means of an air whirl rotating along with the spinning rotor. As soon as these fibers come in contact with the fiber sliding surface of the spinning rotor, they are pulled out via the groove base so that, in addition, there is a relatively strong stretching and parallelizing effect. In this case, the groove may also take over a sort of compressor function whereby the fed fibers are slightly bundled In this case, the shape of the groove does not only depend on the fiber thickness but also depends slightly on the yarn size; i.e., in the case of courser yarn sizes, a slightly larger radius may be selected for the groove base than in the case of fine yarn sizes.

In a further development of preferred embodiments of the invention, it is provided that the end area of the fiber feeding duct is developed as a groove that is V-shaped in its cross-section. As a result, a particularly precise fiber feeding to the fiber sliding wall of the spinning rotor is achieved.

In a further development of preferred embodiments of the invention, it is provided that the length of the end area of the fiber feeding duct that is developed as a groove, including the distance of the fiber feeding duct to the fiber sliding surface of the spinning rotor, corresponds approximately to the staple length of the fiber material to be processed. This ensures that, as a rule, a part of the fibers will still be located in the groove when the starting part has reached the sliding surface. The fibers are then pulled out via the groove base, whereby they are deflected and stretched.

Other objects, advantages and novel features of the present invention will become apparent from the following detailed description of the invention when considered in conjunction with the accompanying drawings

BRIEF DESCRIPTION OF THE DRAWINGS

FIG. 4 is a top of frontal view of the open-end spinning rotor arrangement of FIG. 2 having the fiber feeding duct shown schematically in its contour; and FIGS. 5 to 7 are sectional views taken respectively along lines V—V, VI—VI and VII—VII of the fiber feeding duct according to FIG. 4.

DETAILED DESCRIPTION OF THE DRAWINGS

Figure 1:
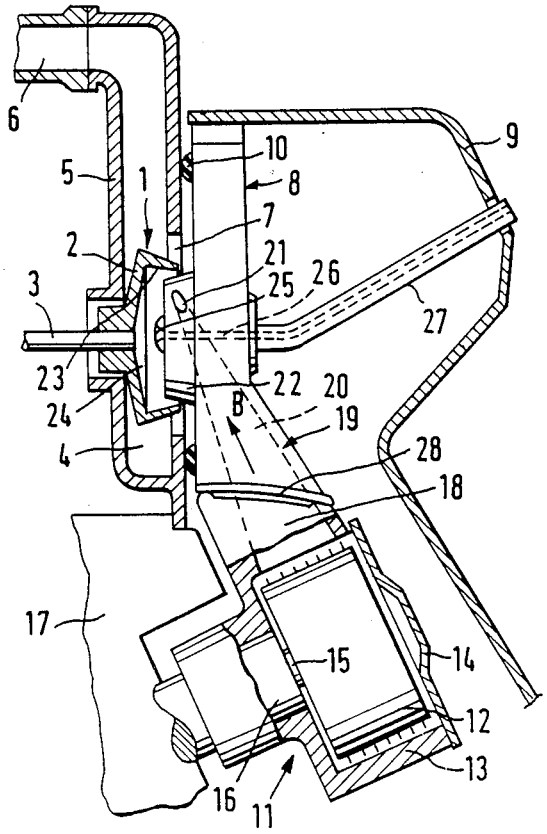
FIG. 1 is a vertical sectional view of an arrangement for open-end rotor spinning constructed in accordance with a preferred embodiment of the invention.

The arrangement for open-end rotor spinning shown in FIG. 1 is part of a machine which on both machines sides contains a plurality of identical spinning units disposed in a row next to one another. Each spinning unit contains a spinning rotor 1 consisting of a rotor 2 and a shaft 3 that is non-rotatably connected with it. The shaft 3 is disposed and driven in a manner that is not shown in detail. The rotor 2 is located in a rotor housing 5 which forms a vacuum chamber 4 surrounding the rotor 2. This vacuum chamber 4 is connected via a pipe 6 to a vacuum source that is not shown. On the side facing away from the shaft 3, the rotor housing 5 has an opening so that the spinning rotor unit 1, as a whole, can be pulled out of the rotor housing 5. This opening 7 is closed off by means of a cover 8 that is mounted on a casing 9 of the spinning unit which, in a manner that is not shown in detail, can be swivelled around a shaft extending in the longitudinal direction of the machine. The cover 8 is equipped with a surrounding sealing ring 10 by means of which it rests against the rotor housing 5 in a sealing manner.

The arrangement also contains a feeding and opening device 11 which has a driven feeding roller that is not shown and interacts with a table, this feeding roller bringing a sliver into the area of a toothed mounting or fitting of an opening roller 12. The opening roller 12 which, on its circumference is equipped with needles or teeth, is rotatably supported in a housing 13 with a shaft 15 by means of a bearing housing arrangement 16. The opening roller 12 is driven via the shaft 15 which projects out of the housing 13. The opening roller housing 13 and the rotor housing 5 are fastened at a machine frame 17. The opening roller housing 13 is covered toward the operating side by a removable cover 14.

The opening roller 12 combs the fiber material fed in sliver shape out into individual fibers which are fed to the spinning rotor unit 1, in the direction of the Arrow (B), i.e., to the rotor 2. The fiber feeding duct 19 starts approximately tangentially at the opening roller 12 and leads into the rotor 2. A first segment 18 of the fiber feeding duct 19 is located in the housing 13 of the opening roller 12. This segment 18 is continued by a segment 20 which is part of the cover 8 which is fastened at the casing 9. The cover 8 can be moved away together with the casing 9, in which case it slides on the opening roller housing 13 by means of a sliding surface 28.

The fiber feeding duct 19, i.e. segment 20, leads into an insert 22 which is part of the cover 8. This insert 22, which has a slightly conical shape, carries a yarn withdrawal nozzle 25 coaxially to the shaft 3 of the spinning rotor unit 1, which nozzle 25 is continued by a yarn withdrawal duct 26 and an adjoining yarn withdrawal tube 27.

Figure 2:
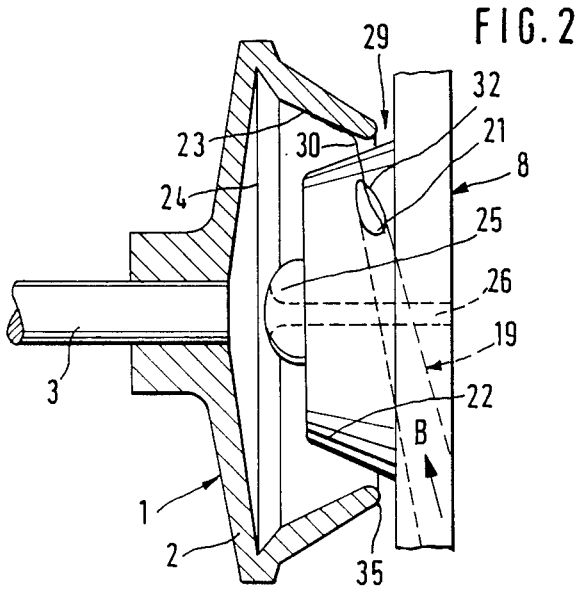
FIG. 2 is an enlarged detail view of the arrangement according to FIG. 1 in the area of the spinning rotor and of a fiber feeding duct.

As shown particularly in FIG. 2, the insert 22 and the cover 8 form a ring gap 29 with the open end 35 of the rotor 2.

During the spinning operation, the fibers separated out by the opening roller 12, are conveyed via the fiber feeding duct 19 into the rotor 2, where they are twisted together into a yarn which is withdrawn via the withdrawal nozzle 25, the yarn withdrawal duct 26 and the yarn withdrawal tube 27. For the withdrawing, a withdrawal device is provided that is not shown and that is followed by a wind-up device that is not shown by means of which the yarn is wound into a cross-wound package. The fiber feeding duct 19 starts at the opening roller 12 with a cross-section that is adapted to the working width of the opening roller 12. Then, the fiber feeding duct 19 tapers in such a manner that the fibers are fed as punctiformly as possible to a certain point of the rotor 2.

As shown by the representation o FIG. 2 which is significantly enlarged in comparison to the natural size, the rotor 2 is provided with a sliding wall 23 which, expands from the open end 35 into a fiber collecting groove 24 which is set off with respect to the sliding wall 23. By means of the vacuum that is applied to the rotor housing 5, a suction air flow is taken into the fiber feeding duct 19 in the direction of the arrow (B). This suction air flow serves mainly for conveying the fibers 30, but also for keeping the area of the opening roller 12 free from flying fibers. The fibers 30, on the one hand, must impact on the fiber sliding surface 23 at a sufficient distance from the open edge 35 of the rotor 2, so that they are not sucked off via the ring gap 29. On the other hand, however, they must impact on the fiber sliding wall 23 also at a distance from the fiber collecting groove 24 that is as large as possible, so that they can slide on this fiber sliding wall 23 and in the process can align and stretch themselves. Today, these requirements cause difficulties in practice because spinning rotor units 1 with rotors 2 must be provided which, in the area of the fiber collecting groove 24, have a diameter of 30 mm and less. Since the fiber sliding wall 23 must have a certain minimum slope, its length is also limited.

Figure 3:
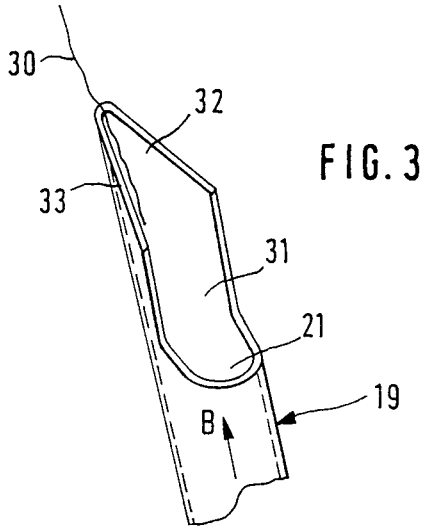
FIG. 3 is a further enlarged representation of the mouth area of the fiber feeding duct of FIGS. 1 and 2.

It is therefore endeavored to feed the fibers 30 as precisely as possible to a certain point of the fiber sliding surface 23 so that for all fibers 30 a safe distance is available from the open edge 35 and a sufficient sliding length is available on the sliding surface 23. At the same time, care must be taken, however, that a sufficiently strong air current flows in the fiber feeding duct 19, i.e., an amount of air that is as large as possible This amount of air depends on the applied vacuum, on the one hand, and on the smallest cross-section 21 in the fiber feeding duct 19, on the other hand. In order to be able to take in a sufficient amount of air, the fiber feeding duct 19, in its end area that is opposite the fiber sliding surface 23, is provided with a lateral slot 31, by means of which slot 31 the smallest cross-section 21 which is decisive for the air flow, is displaced into an area in which the segment 20 of the fiber feeding duct 19 has a larger cross-section (FIG. 3). In order to, nevertheless, obtain a secure guiding of the fibers 30, the area of the fiber feeding duct 19 that adjoins this cross-section 21 is shaped as a V-shaped groove 32 which has a groove base 33, the radius of which amounts to no more than 2.5 mm. As shown particularly in FIG. 4, the groove base 33 faces the center of the rotor 2, i.e., the area of the shaft 3. The slot 31, on the other hand, faces the sliding wall 23 so that, since the rotor 2 with one component is turned in the direction of the fiber feeding duct 19 (direction of Arrow A, FIG. 4), the fibers 30 impacting on the fiber sliding surface 23 are withdrawn via the groove base 33 of the groove 32 and in the process are aligned very well. The length of the end area developed as a groove 32 is dimensioned such that this length, plus the distance between the end of the groove 32 and the fiber sliding wall 23, corresponds to approximately the staple length of the fiber material to be processed.

The slot 31, which opens up the fiber feeding duct 19 toward the fiber sliding surface 23, is constructed to be so long that, in connection with the other dimensions, a sufficient cross-section 21 can be achieved by means of which the desired amount of air can be taken in at given pressure conditions. In this case, it may definitely happen that, which happened in the shown embodiment, the slot 31 projects out of the rotor 2 so that a part of the conveying air is sucked off before reaching the interior of the rotor 2. The limit for this type of an extension of the slot 31 is set by the cover 8 into which the insert 22 merges (FIG. 2).

FIG. 4, for illustration purposes, shows only the fiber feeding duct 19 or the segment 20 of this fiber feeding duct 19 in the manner of a tube which is located in the cover 8. However, it should be observed that in practice this fiber feeding duct 19 or the segment 20 are the component of a cover 8 and of an insert 22 which projects into the rotor 2.

As shown in FIGS. 5 to 7, the fiber feeding duct 19 is constructed such that it continuously changes its cross-section from a round Portion 38, via an approximately oval portion 37, toward the groove 32. In this case, it may be provided that in the oval portion 37, one side 36 has a smaller radius, specifically the side which is located in the extension of the groove 32.

As a modification of the shown embodiment, it is provided that the area of the groove 32 is applied slightly diagonally with respect to the longitudinal axis of the fiber feeding duct 19 toward the interior of the fiber feeding duct 19 so that the fibers 30, to an even larger extent, are forced to move in the groove base 33.

Since the fiber feeding duct 19, in its end area, is formed only of a groove 32 and an opposite slot 31, it is possible without any difficulty to place the fiber feeding duct 19 far in the edge area of the insert 22, i.e., so that its generating line, which is located on the outside in radial direction (see FIG. 4), extends approximately tangentially with respect to the outer circumference of the insert 22. As a result, sufficient space is created for the yarn withdrawal duct 26 and particularly also holding devices for the yarn withdrawal nozzle 25.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A fiber feeding arrangement for an open-end rotor spinning unit of the type having a spinning rotor which has a fiber sliding surface expanding conically into a fiber collecting groove, a rotor housing encasing the rotor, said rotor housing being connecting to an airflow inducing means, a cover for closing off a side of the rotor housing facing an open end of the rotor, and fiber opening means for opening fiber to be supplied to the rotor, said fiber feeding arrangement including fiber feeding duct means extending from the fiber opening means through at least a portion of the cover to a fiber feeding end area of the fiber feeding duct means which opens to supply fibers to the fiber sliding surface of the rotor, said fiber feeding duct means exhibiting a tapered internal cross-section which diminishes in size in the direction toward the fiber feeding end area, wherein the fiber feeding duct means is provided with a lateral slot at the fiber feeding end area which is configured such that the cross-section of the fiber feeding duct means operable to accommodate fiber conveying airflow is disposed in an area of the fiber feeding duct means with a larger diameter than the diameter of the fiber feeding end area closest to the fiber sliding surface of the rotor, and wherein the fiber feeding end area of the fiber feeding duct means is shaped as a groove with a groove base having a radius of no more than 2.5 millimeters (mm).

2. An arrangement according to claim 1, wherein the fiber feeding duct means is disposed in an insert carried by the cover, said insert protruding into an open end face of the rotor during spinning operation.

3. An arrangement according to claim 2, wherein a yarn withdrawal nozzle is also disposed in said insert.

4. An arrangement according to claim 3, wherein the slot faces the fiber sliding surface of the spinning rotor and the groove base faces the yarn withdrawal nozzle.

5. An arrangement according to claim 4, wherein the slot extends into an area of the fiber feeding duct means that is located outside the spinning rotor when in an operative position for spinning at the spinning unit.

6. An arrangement according to claim 4, wherein the fiber feeding end area of the fiber feeding duct means is designed as a groove with a V-shaped cross-section.

7. An arrangement according to claim 4, wherein the length of the end area of the fiber feeding duct means designed as the groove, including the distance of the fiber feeding duct means from the fiber sliding surface of the spinning rotor, corresponds approximately to the staple length of the fiber material to be processed.

8. An arrangement according to claim 7, wherein the end area of the fiber feeding duct means designed as the groove includes groove side walls sloped toward the longitudinal axis of the fiber feeding duct means.

9. An arrangement according to claim 4, wherein the end area of the fiber feeding duct means designed as the groove includes groove side walls sloped toward the longitudinal axis of the fiber feeding duct means.

10. An arrangement according to claim 4, wherein a generating line of the fiber feeding duct means facing away from the center of the spinning rotor is directed to be approximately tangential with respect to the exterior surface of the inserts.

11. An arrangement according to claim 3, wherein a generating line of the fiber feeding duct means facing away from the center of the spinning rotor is directed to be approximately tangential with respect to the exterior surface of the insert.

12. An arrangement according to claim 2, wherein a generating line of the fiber feeding duct means facing away from the center of the spinning rotor is directed to be approximately tangential with respect to the exterior surface of the insert.

13. An arrangement according to claim 1, wherein the slot extends into an area of the fiber feeding duct means that is located outside the spinning rotor when in an operative position for spinning at the spinning unit.

14. An arrangement according to claim 1, wherein the fiber feeding end area of the fiber feeding duct means is designed as a groove with a V-shaped cross-section.

15. An arrangement according to claim 14, wherein the length of an end area of the fiber feeding duct means designed as the groove, including the distance of the fiber feeding duct means from the fiber sliding surface of the spinning rotor, corresponds approximately to the staple length of the fiber material to be processed.

16. An arrangement according to claim 14, wherein the end area of the fiber feeding duct means designed as the groove includes groove side walls sloped toward the longitudinal axis of the fiber feeding duct means.

17. An arrangement according to claim 1, wherein the length of the end area of the fiber feeding duct means designed as the groove, including the distance of the fiber feeding duct means from the fiber sliding surface of the spinning rotor, corresponds approximately to the staple length of the fiber material to be processed.

18. An arrangement according to claim 17, wherein the end area of the fiber feeding duct means designed as the groove includes groove side walls sloped toward the longitudinal axis of the fiber feeding duct means.

19. An arrangement according to claim 1, wherein the end area of the fiber feeding duct means designed as the groove includes groove side walls sloped toward the longitudinal axis of the fiber feeding duct means.

* * * * *